US006251028B1

(12) United States Patent
Jackson

(10) Patent No.: US 6,251,028 B1
(45) **Date of Patent: *Jun. 26, 2001**

(54) GOLF CLUB HAVING A HEAD WITH ENLARGED HOSEL AND CURVED SOLE PLATE

(76) Inventor: Al Jackson, 2590 Pioneer Ave., Vista, CA (US) 92083

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/198,031

(22) Filed: Nov. 23, 1998

Related U.S. Application Data

(63) Continuation-in-part of application No. 08/745,215, filed on Nov. 8, 1996, now Pat. No. 5,839,973, which is a continuation-in-part of application No. 29/058,549, filed on Aug. 19, 1996, now Pat. No. Des. 399,279.

(51) Int. Cl.[7] ..... A63B 53/02

(52) U.S. Cl. ..... 473/305; 473/507; 473/308; 473/314

(58) Field of Search ..... 473/305, 307, 473/308, 314, 327, 328, 246, 248, 258

(56) References Cited

U.S. PATENT DOCUMENTS

| | | | |
|---|---|---|---|
| Re. 34,925 | | 5/1995 | McKeighen . |
| D. 276,836 | | 12/1984 | Cook . |
| D. 298,447 | | 11/1988 | Cook . |
| D. 309,488 | | 7/1990 | Langert . |
| D. 345,775 | | 4/1994 | Poincenot et al. . |
| D. 357,290 | | 4/1995 | Viollaz et al. . |
| D. 375,130 | | 10/1996 | Hlinka et al. . |
| D. 378,770 | | 4/1997 | Hlinka et al. . |
| 669,864 | * | 3/1901 | Simpson ..... 473/314 |
| 1,528,017 | * | 3/1925 | Gammeter ..... 473/327 |
| 1,553,867 | * | 9/1925 | Maas ..... 473/308 |
| 1,643,250 | * | 9/1927 | Longsworth ..... 473/248 |
| 1,665,811 | | 4/1928 | Hadden . |
| 2,067,556 | * | 1/1937 | Wettlaufer ..... 473/314 X |
| 2,083,189 | * | 6/1937 | Crooker ..... 473/327 |
| 2,425,808 | | 8/1947 | Jakosky . |
| 2,962,286 | | 11/1960 | Brouwer . |
| 3,176,987 | | 4/1965 | Johnston . |
| 3,206,206 | | 9/1965 | Santosuosso . |
| 3,330,601 | | 7/1967 | Proctor . |
| 3,601,399 | | 8/1971 | Agens . |
| 3,625,513 | | 12/1971 | Ballmer . |
| 3,907,446 | | 9/1975 | Leslie . |
| 3,941,390 | | 3/1976 | Hussey . |
| 3,984,103 | | 10/1976 | Nix . |
| 4,884,808 | | 12/1989 | Retzer . |
| 4,892,316 | | 1/1990 | Langert et al. . |
| 4,948,132 | | 8/1990 | Wharton . |
| 4,995,609 | | 2/1991 | Parente et al. . |
| 5,042,806 | | 8/1991 | Helmstetter . |
| 5,067,711 | | 11/1991 | Parente et al. . |
| 5,067,715 | | 11/1991 | Schmidt et al. . |

(List continued on next page.)

FOREIGN PATENT DOCUMENTS 2207358A 2/1989 (GB) .

*Primary Examiner*—Raleigh W. Chiu
(74) *Attorney, Agent, or Firm*—Kolisch Hartwell Dickinson McCormack & Heuser

(57) ABSTRACT

A golf club head, and more specifically a hosel for a golf club head, and a method of angularly orienting a golf club shaft relative to a golf club head. The hosel defines a hollow interior for receiving a golf club shaft through an opening, generally along a central longitudinal axis of the hollow interior. The hollow interior is bounded by a wall adjacent the opening, preferably including a substantially planar or flat portion.

29 Claims, 5 Drawing Sheets

U.S. PATENT DOCUMENTS

| | | | | |
|---|---|---|---|---|
| 5,116,047 | * | 5/1992 | Phelan et al. | 473/307 |
| 5,149,091 | | 9/1992 | Okumoto et al. . | |
| 5,163,682 | | 11/1992 | Schmidt et al. . | |
| 5,165,688 | | 11/1992 | Schmidt et al. . | |
| 5,180,166 | | 1/1993 | Schmidt et al. . | |
| 5,183,264 | | 2/1993 | Lanctot . | |
| 5,204,046 | | 4/1993 | Schmidt . | |
| 5,222,734 | | 6/1993 | Parente et al. . | |
| 5,240,252 | | 8/1993 | Schmidt et al. . | |
| 5,244,205 | * | 9/1993 | Melanson et al. | 473/248 |
| 5,273,280 | | 12/1993 | Lo . | |
| 5,275,399 | | 1/1994 | Schmidt et al. . | |
| 5,282,625 | | 2/1994 | Schmidt et al. . | |
| 5,301,946 | | 4/1994 | Schmidt et al. . | |
| 5,308,062 | | 5/1994 | Hogan . | |
| 5,314,184 | | 5/1994 | Schmidt et al. . | |
| 5,316,299 | | 5/1994 | Feche et al. . | |
| 5,318,300 | | 6/1994 | Schmidt et al. . | |
| 5,320,347 | | 6/1994 | Parente et al. . | |
| 5,330,187 | | 7/1994 | Schmidt et al. . | |
| 5,335,914 | | 8/1994 | Long . | |
| 5,344,150 | | 9/1994 | Schmidt et al. . | |
| 5,348,295 | * | 9/1994 | Phillips | 473/314 X |
| 5,351,958 | | 10/1994 | Helmstetter . | |
| 5,395,109 | | 3/1995 | Fenton . | |
| 5,409,229 | | 4/1995 | Schmidt et al. . | |
| 5,411,263 | | 5/1995 | Schmidt et al. . | |
| 5,417,559 | | 5/1995 | Schmidt . | |
| 5,429,355 | | 7/1995 | Schmidt et al. . | |
| 5,429,365 | | 7/1995 | McKeighen . | |
| 5,460,376 | | 10/1995 | Schmidt et al. . | |
| 5,480,152 | | 1/1996 | Schmidt et al. . | |
| 5,484,155 | * | 1/1996 | Yamawaki et al. | 473/328 X |
| 5,507,985 | | 4/1996 | Cadorniga . | |
| 5,511,779 | * | 4/1996 | Meyers et al. | 473/246 |
| 5,513,844 | | 5/1996 | Ashcraft et al. . | |
| 5,577,726 | * | 11/1996 | Fenton | 473/305 |
| 5,632,695 | | 5/1997 | Hlinka et al. . | |

* cited by examiner

GOLF CLUB HAVING A HEAD WITH ENLARGED HOSEL AND CURVED SOLE PLATE

CROSS-REFERENCE TO RELATED APPLICATIONS

This application is a continuation-in-part of U.S. patent application Ser. No. 08/745,215, entitled "Golf Club Head with Enlarged Hosel," filed on Nov. 8, 1996, soon-to-be issued on Nov. 24, 1998 as U.S. Pat. No. 5,839,973, which is a continuation-in-part of U.S. design patent application Ser. No. 29/058,549, entitled "Hosel for a Golf Club," filed on Aug. 19, 1996, issued on Oct. 6, 1998 as U.S. Pat. No. Des. 399,279.

BACKGROUND AND SUMMARY OF THE INVENTION

In the game of golf, a golf club is used to hit a golf ball along a fairway often several hundred yards long, with the ultimate goal of putting the golf ball into a cup just a few inches wide. Simply stated, the object of the game is to put the ball into the cup with as few hits as possible, and it requires great skill and accuracy to meet this goal consistently. While both skill and accuracy are a function of the physical and mental abilities of the golfer, a golfer's equipment has been found to play an important role as well.

For example, some golfers may find they consistently "slice" shots hit with one club (the ball veers to one side of the intended direction), "hook" shots hit with another club (the ball veers to the other side of the intended direction), and hit accurately with yet a third club. Slicing or hooking a shot generally means that the shot will not be as accurate as one without slicing or looking. Similar variations may be found in the distance the ball travels when hit by a particular golfer. Since the accuracy and distance of shots are key factors in winning at golf, a broad range of types and styles of golf clubs have been developed.

A golf club is made up of a shaft by which the club is held by a player and swung, and a head at one end of the shaft for striking a golf ball when the club is swung. The head is attached to the shaft by a shaft-receiving socket formed in the head. This socket is known as the hosel of the head. Conventionally, the hosel fits tightly over the shaft, and the head is bonded to the shaft by epoxy.

Clubs are grouped broadly as woods and irons, with woods having a type of head designed for long distance hits (or drives), and irons having heads designed for shorter hits, or special-situation hits like hitting a ball out of tall grass or a sand trap, or putting the ball when on the green. Particular clubs may be distinguished from others generally by the length and weight of the shaft, the size and weight of the head, and the geometric configuration of the head that determine various angles and displacements of the shaft relative to the ball-striking face of the head. Typically, a club designed for hitting a ball a long distance has a longer shaft and a bigger head than a club designed for hitting the ball a shorter distance.

Since golfers come in all sizes, golf clubs come in various sizes. However, two golfers of the same height and arm length may prefer to play with clubs having different shaft lengths for a given head design, or having different head-to-shaft angles and displacements for a given shaft design. Thus, for optimum performance of a club, the shaft length must be matched to both the geometric configuration of the head and the player holding the shaft. Given the tight fitting hosels of conventional heads, this usually requires a compromise, with the head being chosen to approximate the desired angles and displacements, and the shaft length being matched just to the player, regardless of how this length may change the optimum ball-striking position of the head. All of this is complicated further by the fact that some golfers play with right-handed clubs having the hosel located on the left side of the head, while others play with left-handed clubs having the hosel on the right side of the head.

One way to avoid the compromise discussed above would be to manufacture a whole series of heads of a particular model line, providing a family of heads having a range of angles and displacements from which to choose. This can often be quite expensive for the head manufacturer, multiplying the number of molds required to make a line of heads, and complicating manufacturing and processing. It also requires that the manufacturer gauge market demand within each line of heads for each particular combination of angles and displacements.

For very demanding golfers, and particularly professional golfers, different angles and displacements may be identified for each type of club, and may be identified with such accuracy that the desired angles and displacements are not available from existing molds. Accordingly, the needs of many golfers simply are not met, or are met only at the expense of custom casting of the heads. Furthermore, the delay associated with custom casting may force many players to resort to heads that are readily available, to the detriment of their game.

There is thus a great need for some combination of golf club head and shaft that can be used to meet the exact needs of each golfer economically, accurately, and quickly. The embodiments disclosed herein do just that by providing a head with a hosel that is oversized relative to the shaft, and by attaching the head to the shaft at the desired angles and displacements through the use of a hosel-insert interposed the shaft and the hosel. The interior of the invented hosel preferably is rectangularly shaped. Furthermore, the sole plate of the head is slightly curved to provide better ground contact between the sole plate and the ground, for any particular angular displacement of the head relative to the shaft. The combination of the shaft, hosel and sole plate have been found to provide a superior combination of customizability and playability for the resulting golf clubs.

U.S. Pat. Nos. 3,625,513 and 3,907,446 show golf clubs with heads attached to shafts by hosels that provide minimal adjustability of shaft-to-head angles. However, in both of these patents the hosel is shown to be relatively close-fitting with the shaft, and cylindrical to match the cylindrical shape of the shaft. This allows only the most minimal adjustments of angles, and leaves no room for adjusting the displacements of the head relative to the shaft, as discussed in more detail below.

It is common for a wood to be swung with a head velocity of over 100 mph. Accordingly, conventional wisdom has required a tight-fitting hosel to prevent bending, breaking, or creating excessive shock or vibration. Thus, a typical golf club has a steel shaft with a tight-fitting hosel at one end and further includes a shock-absorbing grip at the other end of the shaft. Even with the heads in U.S. Pat. Nos. 3,625,513 and 3,907,446, this wisdom dictated close-fitting hosels very similar to the tight-fitting hosels of conventional design.

U.S. Pat. No. 5,513,844, incorporated herein by reference, discusses club fitting in the context of what is described as a club-fitting apparatus. However, the apparatus requires the use of a number of different club heads, each having a hosel at different angles, with the hosel releasably clamping a shaft in a close-fitting relationship. Furthermore, the apparatus does not appear to be intended for more normal golf use. Rather, it is described only with respect to testing clubs, not playing with them. Accordingly, the apparatus of U.S. Pat. No. 5,513,844 does not provide a desirable solution to the problems addressed by the present invention.

The present invention, in various embodiments described in more detail below, shows that the conventional hosel design is subject to great improvement. This results in greatly improved golf clubs that are easier to manufacture. The improvements are noticeable when a head including one of the various hosels described herein is used on a conventional shaft, and even more noticeable when such a head is combined with an appropriately selected shaft.

The advantages of the present invention will be understood more readily after a consideration of the drawings and the following detailed description.

DETAILED DESCRIPTION OF EMBODIMENTS OF THE INVENTION

Figure 1:
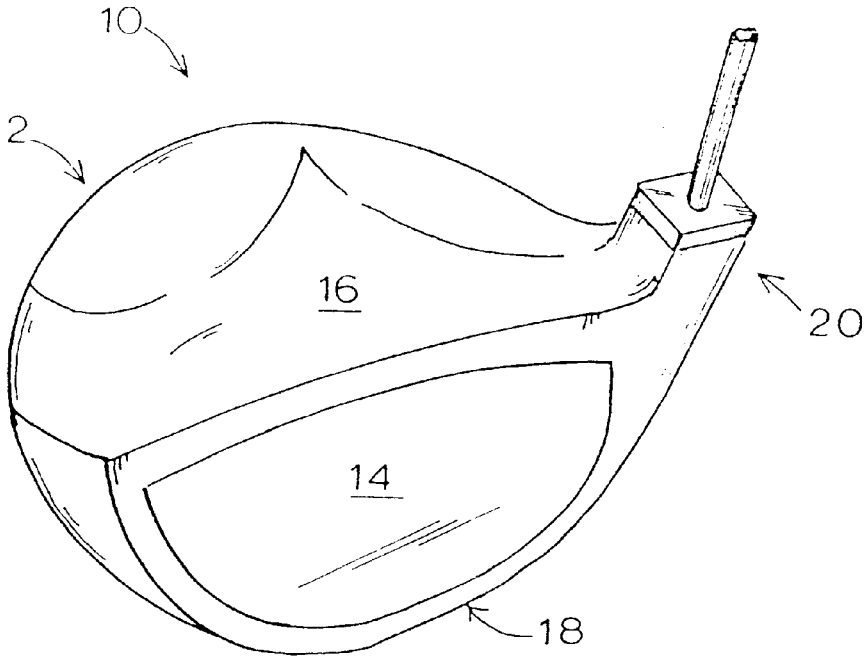
FIG. 1 is an isometric view of a right-handed golf club incorporating the present invention, with a portion of a shaft shown attached to a golf club head, taken generally from the front of the head.

Referring first to FIG. 1, a golf club is indicated generally at 10, comprising a golf club head 12. Head 12 may be any type of head and is shown in the drawings as a hollow metal "wood." Alternatively, head 12 may be an "iron."

Figure 2:
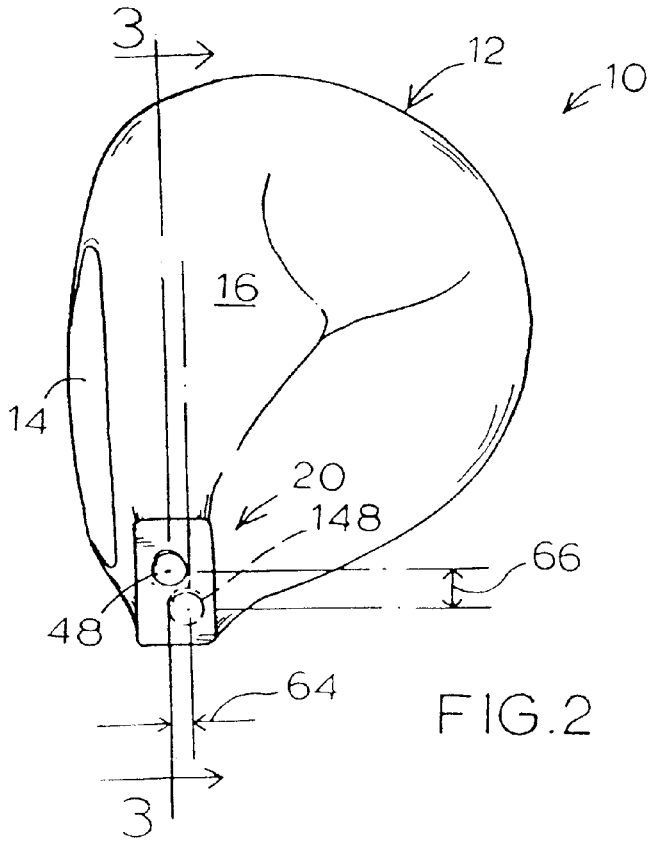
FIG. 2 is a top plan view of the golf club shown in FIG. 1, shown on a slightly smaller scale.

Head 12 includes a striking face 14, a top 16, and a sole plate 18. Sole plate 18 is partially obscured in FIG. 1. In FIG. 2, a different view of club 10 is shown, with sole plate 18 being fully obscured. A hosel 20 is formed adjacent one side of head 12.

Figure 3:
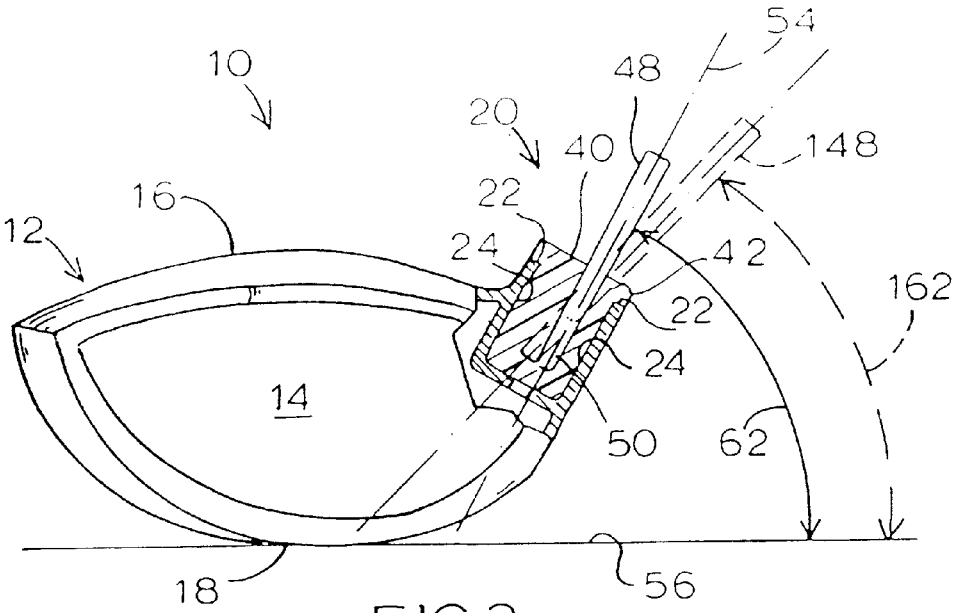
FIG. 3 is a front elevation of the club shown in FIG. 1, with the hosel of the club shown in cross section, taken generally along line 3—3 in FIG. 2, and with an alternative position of the shaft relative to the head shown in dashed lines.
Figure 4:
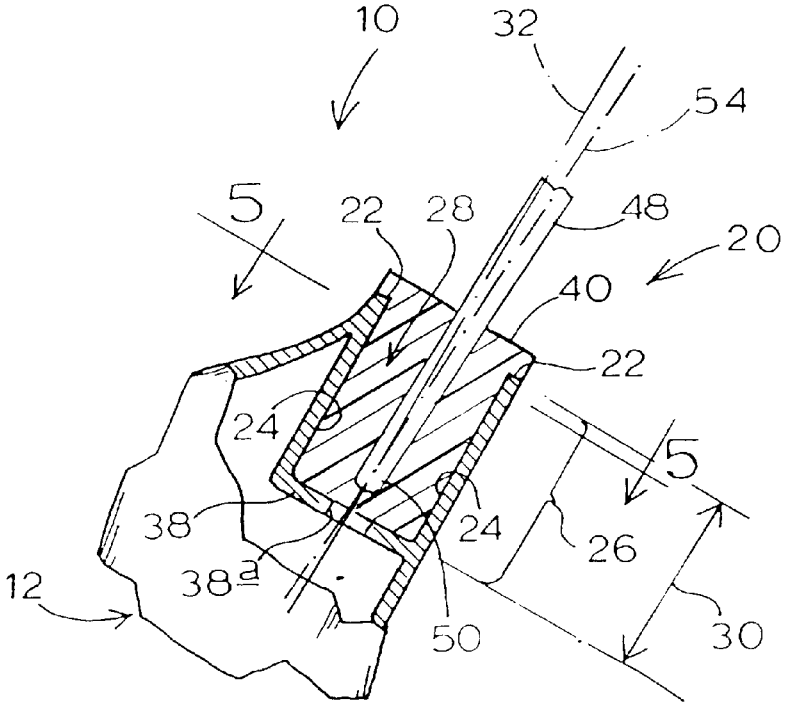
FIG. 4 is an enlarged cross-sectional view similar to that shown in FIG. 3, with only the hosel portion of the head shown.
Figure 5:
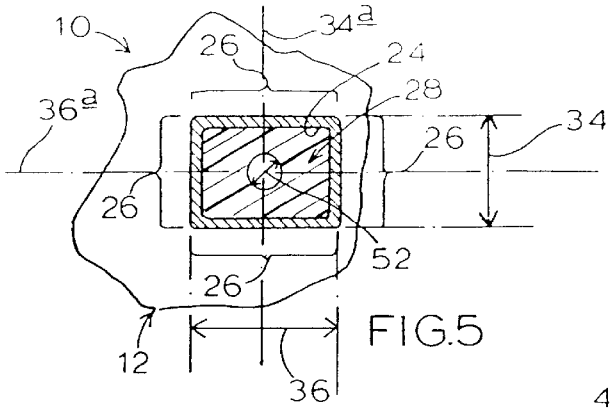
FIG. 5 is a top cross-sectional view of the hosel of the head shown in FIG. 2, taken generally along line 5—5 in FIG. 4.

The specifics of hosel 20 are shown best in FIGS. 3–5, each showing a cross-sectional view of hosel 20. An upper edge 22 defines an opening in hosel 20. Boundary structure preferably in the form of an axial interior sidewall or wall 24 having a plurality of substantially planar portions 26 defines a hollow interior 28. Thus, hollow interior 28 is bounded by a substantially noncylindrical wall 24, 26 adjacent the opening. Hollow interior 28 has a depth indicated in FIG. 4 at 30, and a central longitudinal axis indicated at 32 extending through the opening defined by upper edge 22.

Each substantially planar portion 26, described more broadly as an approximately flat portion 26, preferably is substantially parallel to central longitudinal axis 32. When viewed as in FIG. 5, wall 24 has a cross section that is substantially rectangular or rectilinear in shape, with the cross section taken approximately perpendicular to central longitudinal axis 32 and to wall portions 26. Preferably, the cross section of wall 24 has significantly rounded corners to provide a visually pleasing appearance to hosel 20, and to facilitate proper manufacturing of a hosel-insert, described below.

It will be seen that cross section 24 includes a width 34, measured along a short transverse axis indicated at 34*a*. Cross section 32 also has a length 36, measured along a long transverse axis 36*a*. Width 34 and length 36 provide an additional way to describe hosel 20. Width 34 is a first transverse dimension of hollow interior 28 that is bounded by first portions 26 of interior wall 24 along a first line 34*a* that intersects longitudinal axis 32 at approximately a right angle. Length 36 is a second transverse dimension of hollow interior 28 that is bounded by second portions 26 of interior wall 24 along a second line 36*a* that also intersects longitudinal axis 32 at approximately a right angle. First transverse dimension 34 is preferably substantially less than second transverse dimension. 36.

Boundary structure 24 preferably have differential cross-sectional dimensions when measured along lines that intersect the longitudinal axis at approximately right angles, as shown in FIG. 5 by the difference in dimensions 34 and 36. Preferably, a cross section of boundary structure 24 taken approximately perpendicular to longitudinal axis 32 includes major axis 36*a* and minor axis 34*a*, and major axis 36*a* is longer than minor axis 34*a*. For the preferred constant cross-sectional hosel as shown in the drawings, any cross section of boundary structure 24 taken approximately perpendicular to longitudinal axis 32 includes such a major axis and a minor axis. However, it is possible to construct hosel 20 with varying cross sections, so that the rectangular, differential or major/minor relationship will be found only along a certain segment or segments of longitudinal axis 32, if at all.

In the embodiments shown in FIGS. 3 and 4, a bottom 38 is formed as part of hosel 20, further defining hollow interior 28. A hole 38*a* may be formed in bottom 38, as shown in FIG. 4.

Figure 6:
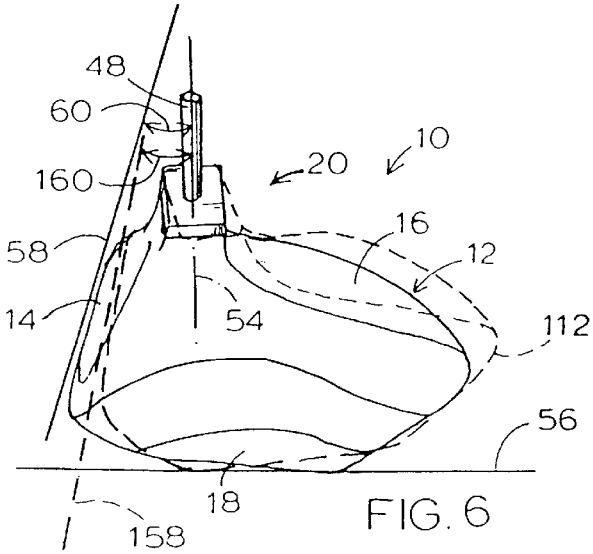
FIG. 6 is a right side elevation of the club shown in FIG. 2, with an alternative position of the head relative to the shaft shown in dashed lines.
Figure 7:
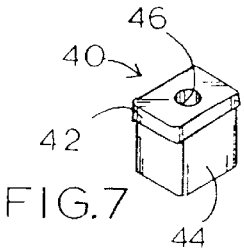
FIG. 7 is an isometric view of an insert fitting in the hosel shown in FIGS. 1–6.

Hollow interior 28 receives an insert 40, preferably predefined to conform in shape to hollow interior 28 prior to its placement in hosel 20, as shown in FIG. 7. Insert 40 preferably includes a collar 42 that limits the extent to which insert 40 may be inserted into hollow interior 28. The portion of insert 40 that is received by hollow interior 28 is indicated as a hosel-conforming external portion 44 that is of an external shape that conforms closely to the boundary structure of hosel 20. A hole 46, seen best in FIG. 7, is formed in insert 40 to receive an elongate shaft 48, seen in FIGS. 1–6.

FIG. 5 shows that at least one or all of flat portions 26 are approximately tangential to shaft 48. By tangential it is meant that a circle may be drawn around and concentric to shaft 48, sized so that one or all of flat portions 26 define tangents to the circle. Stated differently, a flat portion is approximately tangential to shaft 48 if a line may be drawn extending at an approximately right angle to the one of flat portions 26 to intersect the approximate center of shaft 48, as viewed in FIG. 5.

Insert 40 is the device by which head 12 is attached to shaft 48. It is also the device by which shaft 48 is received by hosel 20, through the opening of hosel 20 that is defined by upper edge 22 so that a portion of shaft 48 is encompassed by hollow interior 28. Insert 40 may be formed, as by molding or other suitable method, of a polymer or other suitable material. The combination of head 12, insert 40, and shaft 48 may be held together by epoxy. Alternatively, a settable or curable adhesive may be applied to the adjoining surfaces of hosel 20, insert 40, and shaft 48, and set or cured through the application of heat, microwave energy, or by other devices or methods.

The preferred material for insert 40 is polyether imide filled with graphite carbon fiber, manufactured by General Electric under the registered trademark Ultem. The preferred adhesive is a two part epoxy manufactured by LA Epoxy under the product designation ClubBond 8200. It has been found that this combination of materials allows salvageable removal of shaft 48 from insert 40, and of insert 40 from hosel 20. However, other materials or configurations could be used that make insert 40 sacrificial, so that it cannot be removed without being destroyed. This may be useful for quality control, or to ensure that no permanent damage results to head 12 or shaft 48, as desired.

Figure 8:
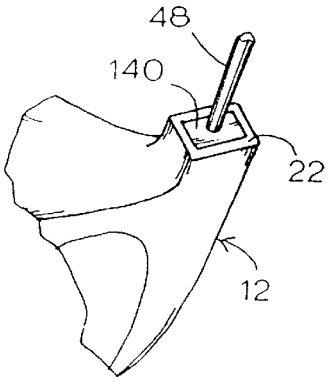
FIG. 8 is a fragmentary isometric view of a hosel portion of an alternative embodiment of the golf club, taken from the upper left front corner of the head, as shown in FIG. 1.
Figure 9:
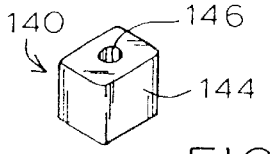
FIG. 9 is an isometric view of the insert of the embodiment shown in FIG. 8.

An alternative embodiment of the insert is shown in FIGS. 8 and 9, indicated as insert 140. In this embodiment, the collar is omitted, and upper edge 22 is exposed as shown. An external portion 144 and a hole 146 are indicated, similar to those shown in the embodiments of FIGS. 1–7. The cross-sectional view of the hosel/insert of the embodiment of FIGS. 8 and 9 would be identical to that shown in FIG. 5, but with different reference characters.

As indicated in FIG. 3, shaft 48 has a hosel portion or head-mounting end 50 that is received and encompassed by insert 40, and in turn by hosel 20. An outer diameter 52 of hosel portion 50 is indicated in FIG. 5, and is of a size relative to width 34 and length 36 of hollow interior 28 such that hollow interior 28 is substantially larger than mounting end 50, with first dimension 34 being at least one-and-a-half times outer diameter 52 of hosel portion 50, and second dimension 36 being at least two times outer diameter 52. Hosel portion 50 of shaft 48 includes an outer profile that may be cylindrical, as with most conventional shafts, or a very slightly tapered frustum of a cone, such as is shown in U.S. Pat. No. 5,569,099, incorporated herein by reference.

One benefit of the hosel of the present invention is that, as part of the attachment of shaft 48 to a particular head 12, the size and configuration of hollow interior 28 of hosel 20 allows substantial adjustment of shaft 48 relative to head 12. These adjustments allow head 12 to be selectively oriented relative to shaft 48 through the orientation of hole 46 in insert 40, as best demonstrated with reference to what is defined herein as the "normal" position of head 12 with respect to a level playing surface. Once a normal position is defined, changes in club 10 may be described as relative changes in the orientation of shaft 48 as it is fixed to head 12. To aid in such descriptions, a longitudinal shaft axis 54 is indicated in FIGS. 3 and 4, as defined by shaft 48, and a level playing surface or ground plane is represented by line 56 in FIGS. 3 and 6.

The normal position of club head 12 is defined as the orientation of head 12 when it is in its optimum ball-striking position. Further definition of the normal position is complicated by the fact that most head designs are highly complex curvilinear shapes, making it difficult to establish a starting reference point. However, if the reader will envision head 12 as an item fixed in space in one specific orientation, such as is shown in each of the figures, the following descriptions may be more clear.

One adjustment of the fixing of shaft 48 to head 12 effectively changes the loft or striking angle of the club. When the club is viewed as shown in FIG. 6, it will be seen that face 14 approximately defines a face plane extending into and out of the sheet, represented by line 58. The angle of line 58 relative to shaft axis 54 is the striking angle, or, more generally, the loft, of the club. Two possible striking angles are indicated in FIG. 6 through changes in the orientation of shaft 48 relative to head 12, which result in a shift of head 12 from its normal position if shaft 48 is held fixed in space. A first striking angle is shown in solid lines at 60. A second striking angle is shown with head 112 in dashed lines, shifted from its normal position. The face plane is represented by line 158 and the striking angle is shown at 160.

A change in striking angle impacts the performance of club 10 because a ball hit by a golf club generally leaves the ground at a higher angle as the striking angle or loft gets greater. This may change the distance or accuracy of a shot hit with the club, and also may allow a player to hit a ball over an obstacle that would otherwise be unavoidable. For some heads, a change in the loft setting relative to the shaft also requires a compensating change in the lie angle and face progression, as shown in FIG. 6 by the counterclockwise rotation of the dashed-line image of head 112 relative to the solid-line image.

Another adjustment changes what is known as the lie angle of the club. Turning to FIG. 3, two possible lie angles are shown, the first with shaft 48 in solid lines, and the second with shaft 148 in dashed lines. The lie angles are indicated at 62 and 162, respectively. Lie angles generally are selected to match a particular length of shaft to a particular player. Some players may prefer longer shafts than others, even among players who all grip the shaft at the same height relative to the ground. The result is that, the longer the shaft, the farther away the head is from the player.

If the lie angle is not matched to the shaft length, some players may have difficulty getting optimum performance out of the resulting club because the head will be tilted away from its optimum, normal position. In FIG. 3, head 12 is shown in its untilted, optimum, normal position, and the shaft is shown in alternative positions. Thus, the adjustments made in the fixing of shat 48 to head 12 serve different purposes with respect to striking angle and lie angle. The striking angle is changed to alter the performance of the resulting club to suit the player. The lie angle, on the other hand, typically is changed to fit the club to the player without tilting the head from its normal position, which would change the performance of the resulting club.

In addition to the angles discussed above, shaft 48 may be fixed closer to or farther from face 14, with lateral displacements measured along transverse axes 34*a* and 36*a* of hosel 20. These lateral displacements may be seen in FIG. 2, in which shaft 48 is shown in solid lines, concentric with central longitudinal axis of hosel 20, and a displaced shaft 148 is shown in dashed lines. A first lateral displacement is indicated at 64, and a second lateral displacement is indicated at 66, both with respect to the principal lateral axes 34*a* and 36*a* of hosel 20.

A conventional sole plate for a driver includes a flat portion that extends approximately perpendicularly to the face of the head, a unique embodiment of which is shown in FIG. 6. Such flat portions often extend along a substantial part of the face, or in more recent designs, just from the approximate center of the face. For example, the sole plates shown in U.S. Pat. Nos. 5,480,152, 5,460,376, and Des. 357,290, incorporated herein by reference, disclose various embodiments of such sole plates. A central, straight ridge extends from the sole plate. This ridge is what contacts the ground when the head is rested on the ground in a normal hitting position, and it provides a golfer with a reference line from which the proper grip is taken.

Figure 10:
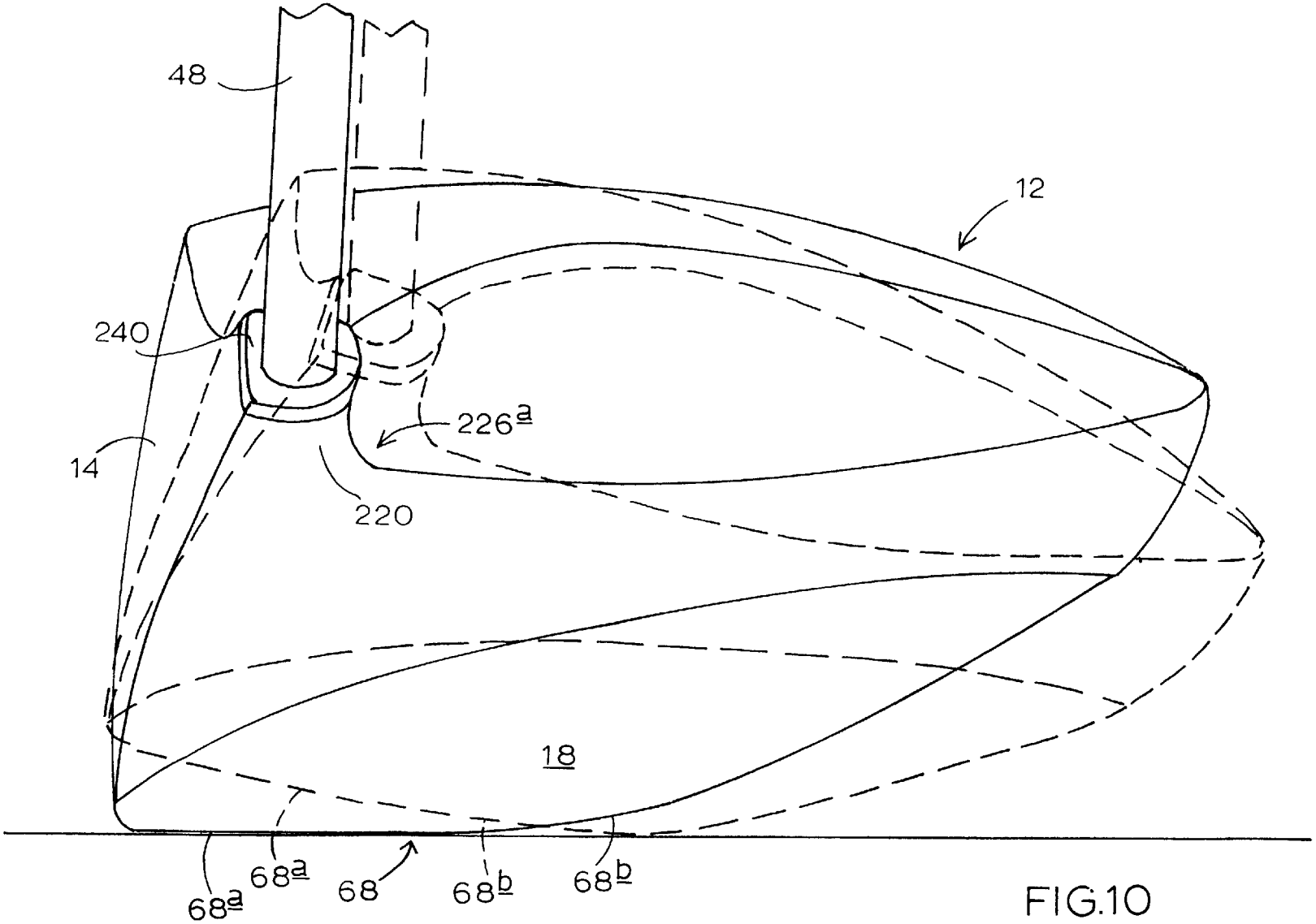
FIG. 10 is a side elevation of an alternative embodiment of the golf club of FIG. 6, showing a slight curvature of the sole plate, with an alternative displacement of the head relative to the shaft shown in dashed lines, with the head rolling from a point adjacent the face (in solid lines) in a direction approximately perpendicular to the face (in dashed lines).

I have found that by shaping sole plate 18 to have an arced sole plate along which the head may roll smoothly on a flat surface to a polar point, as shown in FIG. 10, instead of the conventional continuously flat ridge or expanse, the club is much more easily aligned and gripped. One particular embodiment of head 12 includes a ridge 68 that progresses from a flat ridge portion 68*a* to a slightly curved, progressively convex ridge portion 68*b*. Ridge 68 defines the arced portion of sole plate 18, and it defines a line of points along which head 12 may roll from a point adjacent face 14 in a direction approximately perpendicular to the face, directly along ridge 68.

The alignment of the head for two different angular orientations is shown in FIG. 10. In the first orientation, shown in solid lines, head 12 rests primarily on approximately flat ridge portion 68*a*. Flat ridge portion 68*a* provides a shortened reference line for orienting the club for gripping. Curved ridge portion 68*b* provides an extension of the reference line, if the surface on which head 12 is rested is crushable. Most golf course grasses are soft enough that curved ridge portion 68*b* effectively lengthens the reference line defined by ridge 68.

When head 12 is mounted on shaft 48 using a different angular displacement, as shown in dashed lines in FIG. 10, head 12 is rotated so that head 12 rests primarily on curved portion 68*b*. The slight curvature of curved portion 68*b* allows the resting contact of head 12 with soft grass to approximate a line of contact, so that a proper reference line is provided to help a golfer grip shaft 48 correctly. The radius of curvature of curved portion 68*b* preferably decreases progressing away from face 14 so that the approximate line of contact is kept as close to face 14 as possible. While this results in a decrease in the effective length of the reference line as head 12 is rotated to increase the loft, most players using heads according to the present invention do not need to modify the loft angle by more that one or two degrees. The effective reference line therefore is sufficiently close to the face, and sufficiently long to provide a proper feel to the customized club 10.

FIG. 10 also shows changes in the effective lie angle and face progression of head 12. The dashed-line image of head 12 has been allowed to rotate clockwise, relative to the solid-line image.

Figure 11:
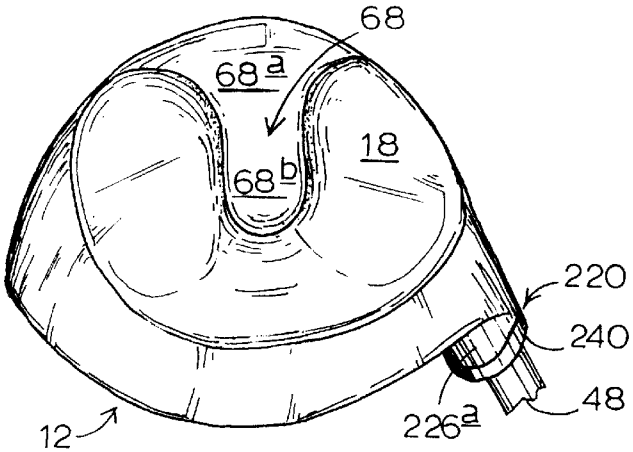
FIG. 11 is an isometric view of the golf club of FIG. 10, taken from below the club to show incorporation of the curved sole plate shown in FIG. 10 in one particular ornamental design of a sole plate.
Figure 12:
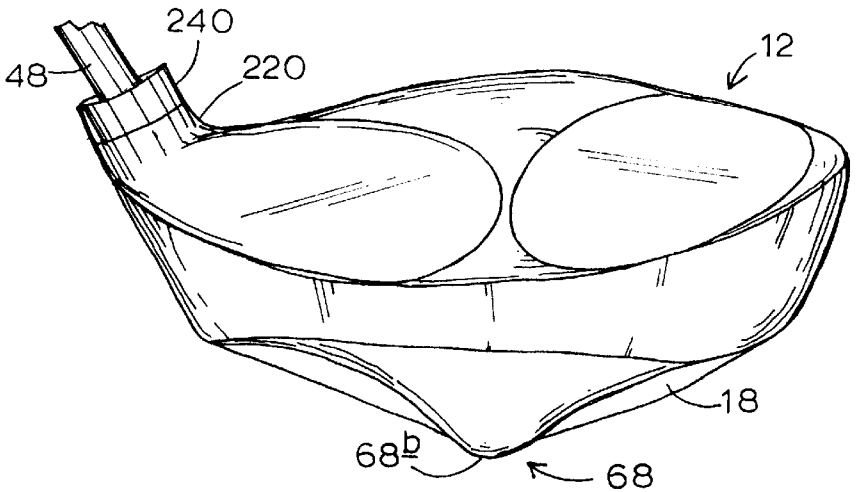
FIG. 12 is a rear elevation of the of the golf club of FIG. 10, showing the head in the alternative displacement of FIG. 10.

FIG. 11 shows a distinctive ornamental appearance of ridge 68, and more generally of sole plate 18. FIG. 12 shows ridge 68, and particularly curved portion 68*b,* from behind head 12, with head 12 in the dashed line position of FIG. 10. It will be appreciated that sole plates having a more conventional ornamental appearance may be used, but that these sole plates preferably are modified to include a curved portion to allow the rolling motion shown in FIG. 10. These conventional sole plates also preferably are modified to be domed slightly to allow heel to toe rolling, as shown in FIG. 12.

FIG. 10 shows another alternative embodiment of the hosel and insert, indicated at 220 and 240, respectively. A back portion of hosel 220 and insert 240 is rounded significantly, as indicated at 226*a,* to allow for additional adjustability of shaft 48 relative to head 12. This allows for additional adjustability, so that shaft 48 is located well within hosel-insert 240, as head 12 is rotated about hosel 220.

To assemble a club from a head 12 having a hosel 20 shaped as described above, the golfer for whom the club is made is measured to determine proper length of a shaft 48, a particular type of shaft 48 and head 12 are selected based on the golfer's preferences, and the golfer's game is analyzed to refine shaft length and to determine optimum shaft-to-head angles and displacements. An insert 40 is made of suitable material to conform to hosel 20. Insert 40 is held in a jig or drill press, and a shaft-conforming hole 46 is formed in insert 40 at the desired angles and displacements. Insert 40 is bonded to shaft 48 and hosel 20 to form a finished club 10. Ideally, the bonding of insert 40 to hosel 20 and shaft 48 is reversible, so that multiple inserts 40, each having a different combination of shaft-to-head angles and displacements, may be experimented with by the golfer to establish the optimum overall geometric configuration of club 10.

The enlarged hosel of the present invention also allows for simplified production of a family of heads with various fixed lofts or face angles. Conventional castings could be made for each of the desired lofts, but the hosel of the present invention would be incorporated in the casting. This would allow a single head to accommodate any desired changes to lie angle, face progression, displacement or shaft length or diameter, without needing to orient the hosel portion of the casting for those particular changes.

From the foregoing identification of the elements and references points of club 10, it will be seen that numerous different descriptions of club 10 of the present invention are possible. Furthermore, the present invention includes a method of angularly orienting golf club shaft 10 relative to golf club head 12. The method includes the steps of providing a shaft 48 with a head-mounting end 50 thereon and providing a head 12 with a hosel 20 formed therein.

It further includes the steps of providing an insert 40 sized to conform to the boundary structure of hosel 20 and fixing insert 40 to the boundary structure of hosel 20. Additional steps include forming in insert 40 a hole 46 sized to conform to head-mounting end 50 of shaft 48 and oriented to place hole 46 at a desired angle relative to head 12 when insert 40 is fixed to the boundary structure of hosel 20, and fixing shaft 48 within hole 46. Insert 40 and hole 46 may be formed substantially simultaneously by placing shaft 48 into hollow interior 28 at the desired angle for hole 46, and placing filler material into hollow interior 28 so that the filler material encompasses at least a portion of head-mounting end 50 of shaft 48. Alternatively, insert 40 and hole 46 may be formed before insert 40 is fixed to hollow interior 28 of hosel 20, or insert 40 may be formed as an integral part of shaft 48. Preferably, insert 40 is first formed from suitable material and then hole 46 is formed by drilling.

As discussed above, the various embodiments of head 12, including the different designs of hosel 20, may be combined with any style shaft to form a finished golf club. However, it is believed that the enlarged hosel 20 of the various embodiments is particularly suited for use with a gripless golf club shaft as is described in U.S. Pat. No. 5,788,585. In that patent, a shaft is described that includes a first elongate segment for mounting to a golf club head, formed by wrapping sheet material around a substantially cylindrical, but very slightly tapered mandrel. The shaft also includes a second elongate frustoconical segment for gripping by a golfer, formed around the first segment and around a slightly frustoconical end segment of the mandrel to produce a smoothly tapering exterior surface of the shaft and an abrupt interior region of joinder between the segments. One such invented shaft is available commercially from AJ Tech, Inc., 2590 Pioneer Avenue, Vista, Calif. 92083, as its 9000™ shaft.

The joinder between the shaft segments preferably is approximately two-thirds of the way from the head-mounting end of the shaft. The shaft tapers such that the outer diameter of its head-mounting end is less than approximately one-third the outer diameter of its gripping end. The shaft also includes an ergonomically designed gripping end, allowing the shaft to be used without the conventional addition of a grip. The shape and smooth, hard surface of the gripping end allows for a great variety of performance-enhancing techniques, by applying padding, adhesives, and/or lubricants to selected portions of the shaft or to a golfer's hands.

The foregoing description of the preferred embodiment of the invention has been presented for purposes of illustration and description. It is not intended to be exhaustive or to limit the invention to the precise form disclosed, and many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined only by the claims.

I claim:

1. A golf club for use in striking a golf ball, the club comprising:

a golf club head including a face for striking a golf ball, a hosel having a hollow interior, and an arced sole plate along which the head may roll smoothly on a flat surface, rolling from a point adjacent the face in a direction approximately perpendicular to the face;

an insert operatively connected to the hollow interior of the hosel; and an elongate shaft having a mounting end operatively connected to the insert;

wherein the hollow interior of the hosel is substantially larger than the mounting end of the shaft so that the face of the head can be selectively oriented relative to the shaft by changing the orientation of the shaft relative to the hosel.

2. The golf club of claim 1, wherein the insert includes at least one approximately flat portion extending approximately tangentially relative to the shaft.

3. The golf club of claim 1, wherein the insert includes at least one approximately flat portion, and at least one approximately significantly rounded portion.

4. The golf club of claim 1, wherein the insert includes at least a pair of opposing approximately flat portions.

5. The golf club of claim 1, wherein:

the shaft is approximately cylindrical, and defines a longitudinal axis;

a cross section of the insert taken approximately perpendicular to longitudinal axis is substantially rectilinear.

6. The golf club of claim 5, wherein the cross section of the insert has significantly rounded corners.

7. A golf club having a shaft and a head, the head comprising:

a face for striking a ball;

a hosel into which the shaft is inserted and fixed, the hosel being oversized relative to the shaft so that the orientation of the shaft may be adjusted relative to the face;

an insert fixed to the hosel and encompassing the shaft at a selected orientation of the shaft relative to the face, the insert and hosel including corresponding approximately flat portions approximately tangential to the shaft to fix the rotational orientation of the insert relative to the hosel; and an arced sole plate along which the head may roll smoothly on a flat surface, rolling from a point adjacent the face in a direction approximately perpendicular to the face.

8. The golf club of claim 7, wherein a cross section of the insert and hosel taken approximately perpendicular to the flat portion is substantially rectilinear.

9. The golf club of claim 7, wherein the insert and hosel include additional corresponding approximately flat portions.

10. The golf club of claim 7, wherein a cross section of the insert and hosel taken approximately perpendicular to the flat portion has significantly rounded corners.

11. The golf club of claim 7, wherein the insert and hosel further includes corresponding approximately significantly rounded portions.

12. A golf club comprising:

an elongated shaft;

a hosel-insert attached to the shaft, and including an outer surface having an approximately flat portion extending along at least a portion of the shaft and hosel-insert; and a head mounted to the insert and thereby to the shaft by a hosel that at least partially encompasses the hosel-insert, and abuts the flat portion of the hosel-insert, wherein the head further includes an arced sole plate along which the head may roll smoothly on a flat surface.

13. The golf club of claim 12, wherein the outer surface of the hosel-insert includes an additional approximately flat portion.

14. The golf club of claim 12, wherein a cross section of the hosel-insert taken approximately perpendicular to the flat portion is substantially rectilinear.

15. The golf club of claim 12, wherein a cross section of the hosel-inert taken approximately perpendicular to the flat portion has significantly rounded corners.

16. The golf club of claim 12, wherein the approximately flat portion is approximately tangential to the shaft.

17. A golf club for use in striking a golf ball, the club comprising:

an elongate shaft;

an insert operatively connected to the shaft; and a golf club head operatively attached to the shaft, the head including a face for striking a golf ball and a hosel for receiving the insert and shaft; and wherein:

the hosel is substantially larger than the mounting end of the shaft so that the face of the head can be selectively oriented relative to the shaft by changing the orientation of the shaft within the hosel;

the insert and hosel have differential cross-sectional dimensions when measured along lines that intersect the shaft at approximately right angles; and the head further includes an arced sole plate along which the head may roll smoothly on a flat surface, rolling from a point adjacent the face in a direction approximately perpendicular to the face.

18. The golf club of claim 17, wherein the insert and hosel each includes an approximately flat portion.

19. The golf club of claim 17, wherein the insert and hosel each includes at least two opposing approximately flat portions.

20. The golf club of claim 17, wherein a cross section of the insert and hosel taken approximately perpendicular to the shaft is substantially rectilinear.

21. The golf club of claim 17, wherein a cross section of the insert and hosel taken approximately perpendicular to the shaft has significantly rounded corners.

22. The golf club of claim 21, wherein the cross section of the insert and hosel is substantially rectilinear.

23. The golf club of claim 17, wherein a cross section of the insert and hosel taken approximately perpendicular to the shaft includes a major axis and a minor axis, and the major axis is longer than the minor axis.

24. The golf club of claim 17, wherein any cross section of the insert and hosel taken approximately perpendicular to the shaft includes a major axis and a minor axis, and the major axis is longer than the minor axis.

25. A golf club having a shaft and a head, the head comprising:

a face for striking a ball;

a hosel into which the shaft is inserted and fixed, the hosel being oversized relative to the shaft so that the orientation of the shaft may be adjusted relative to the face;

an insert fixed to the hosel and encompassing the shaft at a selected orientation of the shaft relative to the face, the insert and hosel including corresponding approximately flat portions approximately tangential to the shaft to fix the rotational orientation of the insert relative to the hosel; and an sole plate along which the head may roll smoothly on a flat surface to a polar point.

26. A golf club comprising:

an elongated shaft;

a hosel-insert attached to the shaft, and including an outer surface having an approximately flat portion extending along at least a portion of the shaft and hosel-insert; and a head mounted to the insert and thereby to the shaft by a hosel that at least partially encompasses the hosel-insert, and abuts the flat portion of the hosel-insert, wherein the head further includes an sole plate along which the head may roll smoothly to a polar point.

27. A golf club for use in striking a golf ball, the club comprising:

an elongate shaft;

an insert operatively connected to the shaft; and a golf club head operatively attached to the shaft, the head including a face for striking a golf ball and a hosel for receiving the insert and shaft; and wherein:

the hosel is substantially larger than the mounting end of the shaft so that the face of the head can be selectively oriented relative to the shaft by changing the orientation of the shaft within the hosel;

the insert and hosel have differential cross-sectional dimensions when measured along lines that intersect the shaft at approximately right angles; and the head further includes a sole plate along which the head may roll smoothly on a flat surface to a polar point.

28. A method for customizing a golf club for a golfer, said club having a head, a hosel comprising a non-circular bore having an axis, and a hosel insert arranged to fit within said non-circular bore and having a bore for receiving said shaft, wherein said club has a nominal angular orientation to said shaft-receiving bore is parallel to said non-circular bore axis, comprising determining a desired deviation of lie angle of said head from a nominal lie angle determining a desired deviation of face progression of said head from a nominal face progression and determining a desired deviation of loft of said head from a nominal loft, computing from said desired lie angle, said desired face progression and said desired loft an angular relation of said shaft to said axis of said non-circular bore, and supplying said hosel insert with a shaft receiving bore with said computer angular relation.

29. A method as specified in claim 28, wherein said supplying said hosel insert includes forming said shaft-receiving bore in said hosel insert.

* * * * *

UNITED STATES PATENT AND TRADEMARK OFFICE

CERTIFICATE OF CORRECTION

PATENT NO. : 6,251,028 B1
DATED : June 26, 2001
INVENTOR(S) : Al Jackson

It is certified that error appears in the above-identified patent and that said Letters Patent is hereby corrected as shown below:

Column 12,
Line 36, before "shaft-receiving", please insert -- shaft when said --.
Line 45, please replace "computer" with -- computed --.

Signed and Sealed this

Fourteenth Day of May, 2002

*Attest:*

*Attesting Officer*

JAMES E. ROGAN
*Director of the United States Patent and Trademark Office*